US006915576B2

(12) United States Patent
Brzezinski

(10) Patent No.: US 6,915,576 B2
(45) Date of Patent: Jul. 12, 2005

(54) ILLUMINATED SAFETY RAZOR

(76) Inventor: Lisa M. Brzezinski, W255 N9380 Tomahawk Dr., Sussex, WI (US) 53089

( * ) Notice: Subject to any disclaimer, the term of this patent is extended or adjusted under 35 U.S.C. 154(b) by 0 days.

(21) Appl. No.: 10/869,921

(22) Filed: Jun. 18, 2004

(65) Prior Publication Data

US 2005/0034307 A1 Feb. 17, 2005

Related U.S. Application Data

(60) Provisional application No. 60/494,287, filed on Aug. 12, 2003.

(51) Int. Cl.[7] ..... B26B 21/46

(52) U.S. Cl. ..... 30/34.05; 30/123; 362/115

(58) Field of Search ..... 30/34.05, 123; 362/115, 120

(56) References Cited

U.S. PATENT DOCUMENTS

| | | | | |
|---|---|---|---|---|
| 1,180,686 A | | 4/1916 | Allport | |
| 1,900,965 A | * | 3/1933 | Weiss | 362/115 |
| 1,950,789 A | * | 3/1934 | Eells | 362/115 |
| 2,225,405 A | * | 12/1940 | Osterman | 362/579 |
| 2,635,179 A | * | 4/1953 | Bowman | 362/577 |
| 4,094,062 A | | 6/1978 | Papanikolaou | |
| 4,473,943 A | | 10/1984 | Papanikolaou | |
| 5,582,476 A | | 12/1996 | Hansen | |
| 6,227,676 B1 | | 5/2001 | Sneddon | |
| 6,386,727 B1 | * | 5/2002 | Yeh | 362/119 |

FOREIGN PATENT DOCUMENTS

GB 2 398 533 A * 8/2004

* cited by examiner

*Primary Examiner*—Hwei-Siu Payer
(74) *Attorney, Agent, or Firm*—Richard C. Litman

(57) ABSTRACT

The illuminated safety razor has a substantially transparent handle and a razor head adapted to hold a razor blade cartridge. A high-intensity LED disposed in the razor head illuminates the area to be shaved. The LED may be molded within the razor head in various orientations dependent upon the contour of the razor head and the desired lighting effect. The handle open at the rear end, is adapted to receive at least one battery. A threaded end cap engages the opening, abutting the battery and contains a micro-pushbutton switch. Depressing a waterproof diaphragm covering the rear of the end cap toggles the switch, supplying a voltage to the LED, thereby illuminating the razor and the area to be shaved.

8 Claims, 4 Drawing Sheets

ILLUMINATED SAFETY RAZOR

CROSS-REFERENCE TO RELATED APPLICATION

This application claims the benefit of U.S. Provisional Patent Application Ser. No. 60/494,287, filed Aug. 12, 2003.

BACKGROUND OF THE INVENTION

1. Field of the Invention

The present invention relates to the field of safety razors, and more particularly, to a razor that illuminates the area to be shaved.

2. Description of the Related Art

While many people have switched to electric razors for convenience or comfort, a good percentage of the shaving population, both men and women still prefer the closeness of a razor blade or prefer to shave in the comfort of the shower or bath where the use of an electric razor may be either detrimental to one's heath or to the life of the razor. Because of the flexibility of location as to where one shaves, lighting may not be available to the extent necessary to guarantee a close shave free from nicks and cuts. Starting almost at the beginning of the twentieth century, illuminated safety razors have been developed to mitigate these problems. However leaking seals and less than adequate light continue to push the development for a more efficient illuminated safety razor.

U.S. Pat. No. 1,180,686, issued to K. Allport in April 1916, discloses a handheld tubular razor having a lamp filament, a battery, and a threaded setscrew to energize the lamp. The lamp and razor is adjustable to provide for directing the light to either side of the razor blade. Although fulfilling the primary purpose of illuminating the area to be shaved, the '686 patent does not address any waterproof properties of the razor.

U.S. Pat. Nos. 4,094,062 and 4,473,943, issued to S. Papanikolaou in June 1978 and October 1984, respectively, both disclose an illuminated razor having a sealed electric circuit including a battery and a bulb. Both patents further disclose a razor head formed of light conductive, and partially reflective, acrylic plastic, translucent material for piping light around corners, and a means for sealing the electric circuit from water. The '062 patent has a razor head designed to illuminate the area just shaved, while the '943 patent has a razor head designed for illuminating the area to be shaved. The '062 patent has a slide switch for activating the light, and a removable end portion to allow access to the battery chamber. Whereas two sealing mechanisms, one for the switch and one for the battery access, are required in the '062 patent, the '943 patent provides an improvement on the earlier design by having a single seal behind the razor's head, which provides access to the bulb and battery compartment and incorporates a switch activated by twisting the razor head in relation to the barrel of the razor.

U.S. Pat. No. 5,582,476, issued to J. Hansen in December 1996, discloses a safety razor having a hollow tube filled with bundles of optical fiber leading from a source of light within the razor's handle to windows directed toward the area adjacent the razor blade. A switch is provided to activate the light source.

U.S. Pat. No. 6,227,676, issued to L. Sneddon in May 2001, discloses a combination of luminescent shaving gel and a razor having an ultraviolet or "black light" element for illuminating hairs missed during the shaving process. The razor incorporates a replaceable battery in the handle, an ultraviolet light source in the razor head and a switch for controlling the flow of electricity to the light source.

None of the above inventions and patents, taken either singly or in combination, is seen to describe the instant invention as claimed. Thus, an illuminated safety razor solving the aforementioned problems is desired.

SUMMARY OF THE INVENTION

The illuminated safety razor has a molded, elongated handle and a razor head formed of a substantially transparent material, adapted to hold a razor blade cartridge. Molded within the razor head is a high-intensity light emitting diode (LED) for illuminating the area to be shaved. The handle portion of the razor has a single opening at the rear of the handle and is adapted to receive at least one battery. A threaded end cap engages the rear of the handle and contains a micro-pushbutton switch electrically connected to the battery and the LED. Depressing the rear of the end cap operates to toggle the operative state of the LED. The LED may be oriented in pre-determined positions, depending upon the contour of the razor's head and the desired lighting effect.

Access to the battery compartment is at the rear of the razor and has been positioned so that, unless totally immersed in water, the battery access will be least likely to be immersed. An O-ring seal may be provided between the end cap and the base of the threaded opening to improve the reliability of the seal between the internal cavity of the razor and the external environment.

A rubber or other pliable and waterproof cap covers a micro-pushbutton switch mounted in the rear of the end cap, the center of the cap acting as a diaphragm which, when depressed by a user, toggles the operative state of the switch.

The battery compartment may be adapted to receive a single "button" style lithium battery, or may be adapted to receive at least one or more batteries of other composition (alkaline, rechargeable nickel-cadmium, nickel metal hydride, etc.) well known in the art for illuminating LEDs.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
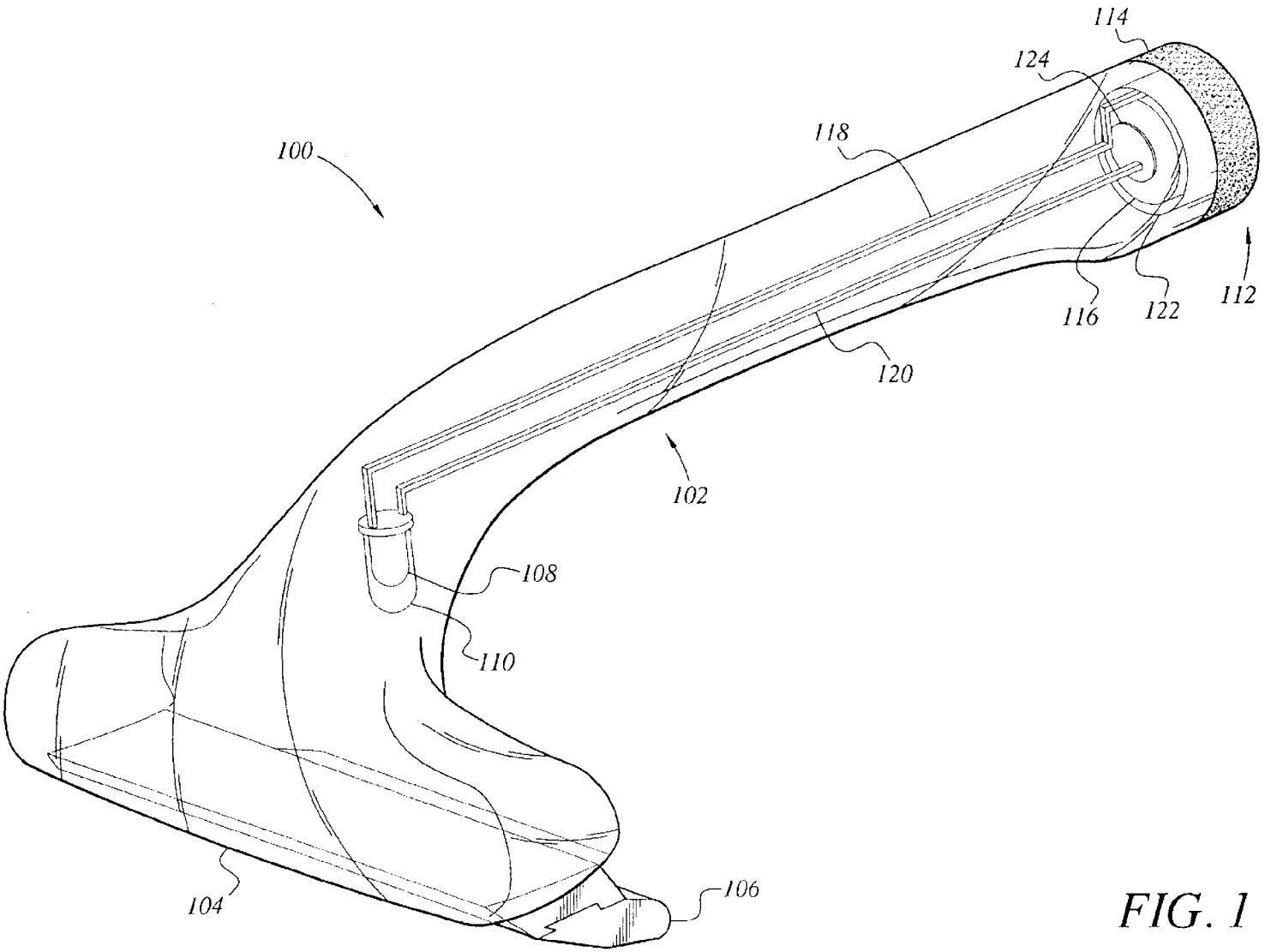
FIG. 1 is a perspective view of an illuminated safety razor according to the present invention.

The present invention is an illuminated safety razor, designated generally as 100 in the drawings. The razor, is designed to illuminate the area to be shaved and contains a single opening positioned in the rear of the handle in order to minimize contact with water.

As shown in FIG. 1, the body of the illuminated razor 100 has a razor head 104 and handle 102 formed of a single, monolithic transparent or translucent member of a plastic material, such as the acrylic resin marketed as Lucite® (a trademark of E. I. du Pont de Nemours & Co. of Wilmington, Del.), or other known clear or light transmitting material. The head 104 formed at a terminal end of the handle 102 is adapted to receive a standard cartridge razor 106 of the variety currently known in the field, and includes such models as the Gillette Trak II®, Gillette Mach3 Turbo®, and Venus® (all trademarks of The Gillette Company of Boston, Mass.) razor blade cartridges. The other end of the elongated handle 102 has a cavity 122 defined within and is sized to receive a battery 116, such as a lithium button battery. The cavity 122 is accessed and protected from water intrusion by end cap assembly 112, which is received by the externally threaded end of elongated handle 102. End cap assembly 112 is formed of a plastic material, such as polypropylene, and is covered by a waterproof rubber covering 114.

Figure 2:
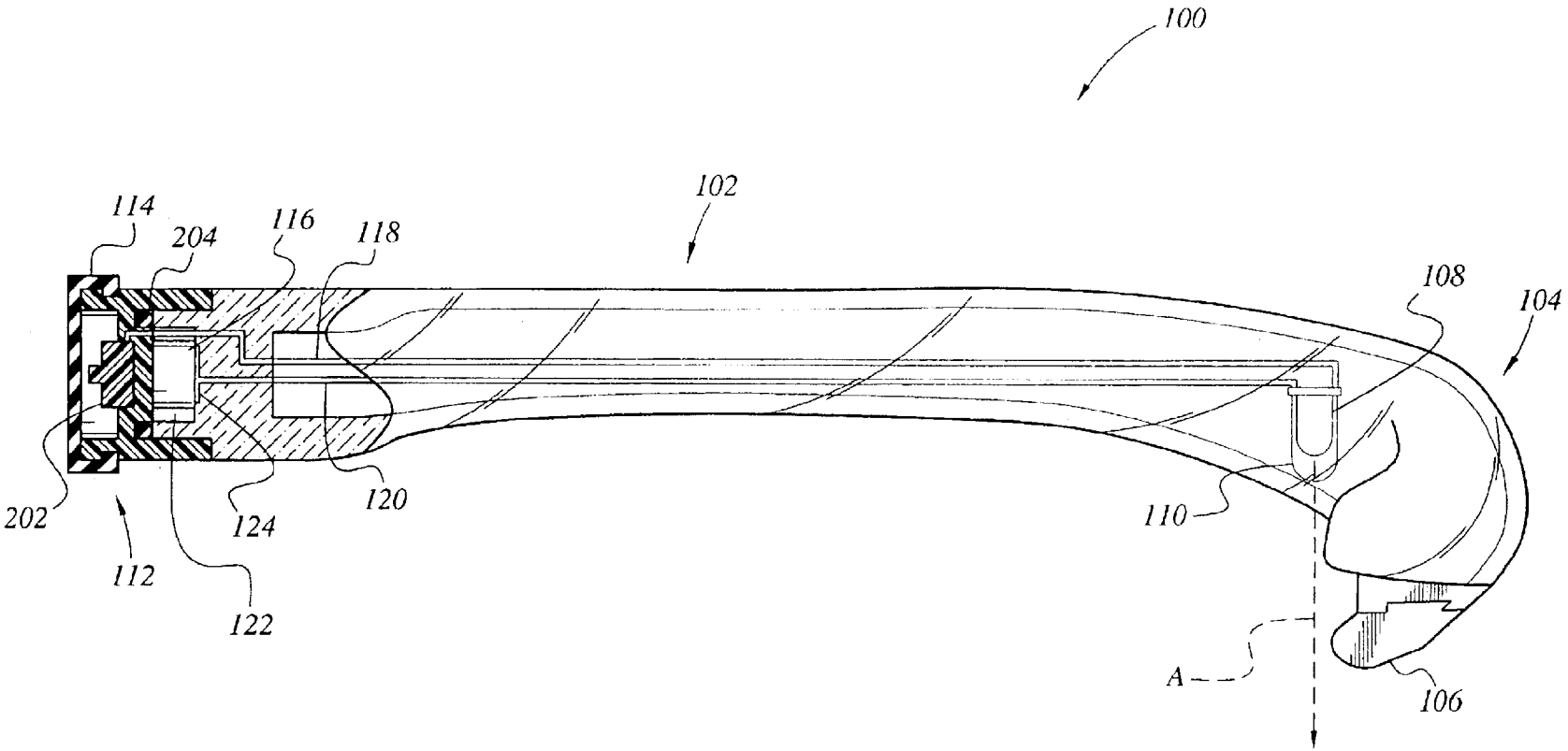
FIG. 2 is a side view of the illuminated safety razor according to FIG. 1.

As best illustrated by FIG. 2, a high-intensity LED 108 is disposed within the razor head 104 and operates to illuminate the razor head 104, handle 102, and the area to be shaved. Those skilled in the art will appreciate that a high-intensity LED will not only provide sufficient light to illuminate the area to be shaved, but will provide a level of durability, reliability, and endurance unattainable with older incandescent lamps. Therefore, a long-lasting LED precludes the need for replacing an illuminating element, such as an incandescent lamp, and will enable LED 108 to be integrated within the razor head 104 at the time of manufacture. A small cavity 110 may be formed within the head 104 around the LED 108 so that the hot portion of the lens of LED 108 will not be in contact with the plastic head 104.

Figure 3:
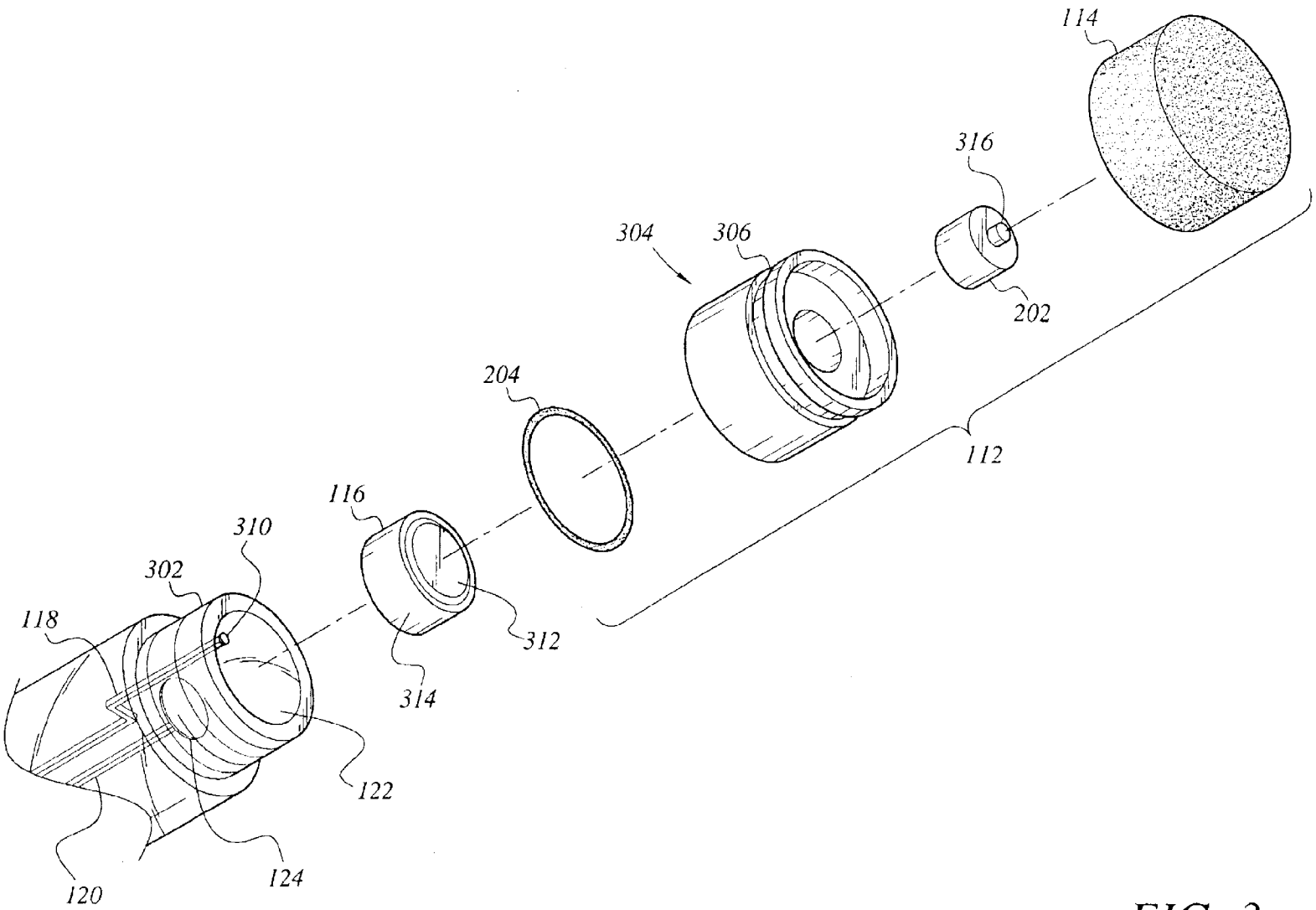
FIG. 3 is an exploded perspective view of the handle end portion of the illuminated safety razor according to FIG. 1.

As shown in the exploded view of FIG. 3, end cap assembly 112 is comprised of a plastic cap 304 internally threaded to receive externally threaded end 302 of handle 102. A resilient O-ring 204, inserted into a circular recess disposed in the base of plastic cap 304, establishes a waterproof seal between the interior portion of the razor 100 and the external environment.

An electrically conductive terminal 124 disposed at the base of the cavity 122 is in electrical contact with a first battery terminal 314, and is electrically connected by wire 120 to one terminal of LED 108.

A micro-pushbutton switch 202 mounted in the end cap 112 operates to turn the LED 108 on and off. A first switch terminal abuts second battery terminal 312, and the second switch terminal abuts electrical contact 310, which is in electrical contact through wire 118 with the second terminal of LED 108.

A rubber or otherwise pliable and waterproof cover 114 engages a circular groove 306 defined within the outer circumference of plastic cap 304, and provides a waterproof covering for the centrally disposed plunger portion 316 of micro-pushbutton switch 202. The center of cap 114 is in substantial contact with the centrally disposed switch plunger 316, and is resilient so that, when depressed by a user, the operative state of switch 202 is toggled, turning the illuminated razor 100 on and off, thereby illuminating the razor 100 and projecting light forward of the area to be shaved.

Light emitted from LED 108 is dispersed within the plastic razor. The light beam A is directed towards the surface to be shaved by a path which is dependent upon factors including, but not limited to, the contour of the razor head 104, the clarity of the plastic, and the index of refraction of the plastic material.

The present invention may be presented in different embodiments disclosing alternative razor head contours, battery styles, and end cap configurations. Inherent to all embodiments is a single razor head and handle construction, manufactured from clear or translucent material, having a high-intensity LED formed in the head, and a pushbutton switch disposed in the rear of an end cap disposed at the rear of the handle.

Figure 4:
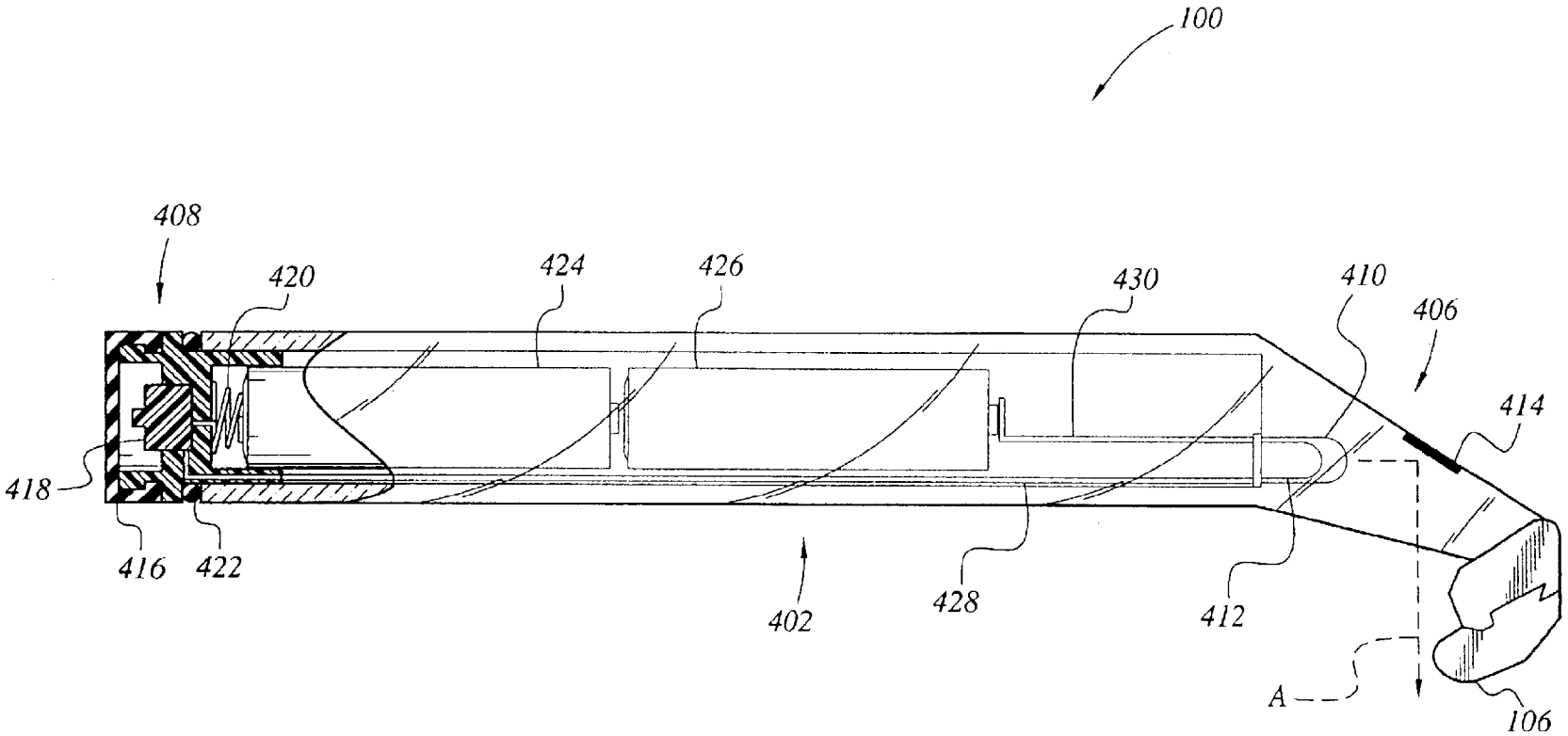
FIG. 4 is a side view of an alternate embodiment of the illuminated safety razor having the LED in axial alignment with the elongated body of the razor.

One such alternate embodiment is presented in FIG. 4 and discloses an illuminated razor having a razor head 406, adapted to receive razor cartridge 106, and incorporating an LED 412 in axial alignment with a generally hollow handle portion 402. As in the first embodiment of FIGS. 1 and 2, a space 410 separates the heated lens of LED 412 from the plastic razor head 406. The handle 402 is adapted to receive a pair of small batteries 424, 426 such as the AAA style battery or equivalent. The end of handle 402 receives end cap assembly 408, a tight waterproof seal being achieved by means of an O-ring 422 compressed between the end cap assembly 408 and the end of handle 402. As in the first embodiment, a rearward mounted pushbutton switch 418 is covered by rubber end covering 416, which when depressed toggles the active state of LED 412. In addition, an electrically conducting compression spring 420 is adapted to make electrical contact with battery 424, and conducting wires 428, 430 provide electrical connectivity between the LED 412, battery 426, and switch 418.

As disclosed in the first embodiment of FIGS. 1 and 2, the light beam A, emitted from LED 412, is directed towards the surface to be shaved by a path which is dependent upon factors including, but not limited to, the contour of the razor head 406, the clarity of the plastic, and the index of refraction of the plastic material. A reflective surface 414 may be disposed on a surface of the razor head 406 to facilitate the direction of reflected light A.

It is to be understood that the present invention is not limited to the embodiments described above, but encompasses any and all embodiments within the scope of the following claims.

I claim:

1. An illuminated safety razor, comprising:

a molded, elongated member formed of a substantially transparent material, the member defining a razor head adapted for receiving a razor blade cartridge and a handle extending from the razor head, the handle being hollow and terminating in a threaded opening;

a high intensity light emitting diode (LED) disposed in the razor head and having first and second terminals, the LED being oriented to project light forward of a line of travel of the razor head;

a threaded end cap removably disposed over the threaded opening in the handle;

at least one battery receptacle formed within the elongated member, the receptacle having first and second battery terminals, the first battery terminal being in electrical contact with the first LED terminal; and a switch disposed in the end cap and having first and second switch terminals, the first switch terminal being in electrical contact with the second battery terminal, the second switch terminal being in contact with the second terminal of the LED;

wherein activation of the switch projects light produced by the LED forward of an area to be shaved.

2. The illuminated safety razor according to claim 1, further comprising sealing means for providing a waterproof seal between the end cap and the threaded opening.

3. The illuminated safety razor according to claim 2, wherein said sealing means comprises a waterproof gasket disposed between said end cap and said threaded opening.

4. The illuminated safety razor according to claim 1, wherein said LED is axially aligned with an elongated axis defined by the handle.

5. The illuminated safety razor according to claim 1, wherein said LED is aligned normal to a longitudinal axis defined by the handle.

6. The illuminated safety razor according to claim 1, further comprising a reflective material disposed on a surface of the razor head for inwardly reflecting light generated by the LED.

7. The illuminated safety razor according to claim 1, wherein said switch is a micro-pushbutton switch.

8. The illuminated safety razor according to claim 7, wherein said end cap has a resilient center disposed over said micro-pushbutton switch, whereby said LED is illuminated by pressing the resilient center of said end cap.

* * * * *